United States Patent [19]

Borazjani

[11] Patent Number: 5,000,461

[45] Date of Patent: Mar. 19, 1991

[54] PORTABLE SOCCER GOAL APPARATUS

[76] Inventor: Abdul H. Borazjani, 700 Patricia Dr., #E-1, Nashville, Tenn. 37217

[21] Appl. No.: 509,064

[22] Filed: Apr. 13, 1990

[51] Int. Cl.[5] ..... A63B 63/04

[52] U.S. Cl. ..... 273/401; 273/181 F; 273/400; 273/29 BD

[58] Field of Search ..... 273/398, 399, 400, 401, 273/411, 394, 181 F, 29 BD

[56] References Cited

U.S. PATENT DOCUMENTS

| | | | |
|---|---|---|---|
| 713,275 | 11/1902 | Atkins | 273/394 |
| 742,927 | 11/1903 | Stults | 273/401 |
| 3,197,208 | 7/1965 | Makar | 273/181 F |
| 3,810,618 | 5/1974 | Nedwick | 273/401 X |
| 4,068,846 | 1/1978 | Forrest | 273/181 F X |
| 4,169,598 | 10/1979 | Taylor | 273/400 |
| 4,523,760 | 6/1985 | Bednarczuk | 273/181 F |
| 4,556,219 | 10/1985 | Tillery | 273/181 F |
| 4,750,744 | 6/1988 | Michalec | 273/181 F X |
| 4,905,996 | 3/1990 | Tallent et al. | 273/401 X |

*Primary Examiner*—William H. Grieb
*Attorney, Agent, or Firm*—Leon Gilden

[57] ABSTRACT

Apparatus including a rectangular forward framework with a triangular framework mounted rearwardly and orthogonally to each end of the rectangular framework with a net structure overlying the triangular framework rearwardly of the forward framework. The forward framework includes a horizontally repositionable forward net wherein the forward net includes a target cup of relatively rigid construction relative to the forward net and repositionable therewith to provide a rear end target position. The forward net may be removed with a flexible web overlying the forward framework mounting a series of diametrically aligned openings of increasing diameters to provide varying targets in use.

6 Claims, 4 Drawing Sheets

PRIOR ART

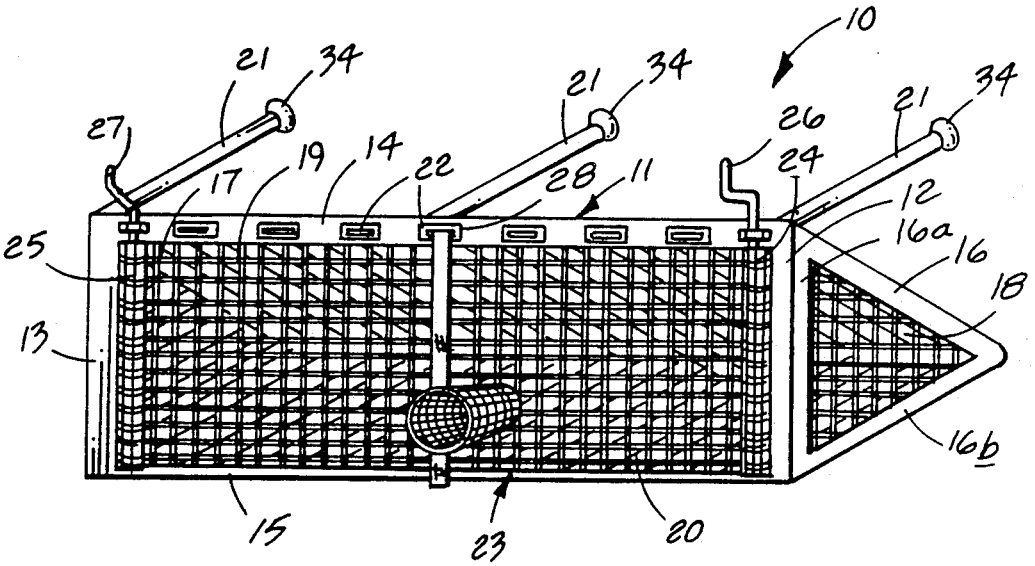
Fig 3
Fig 4
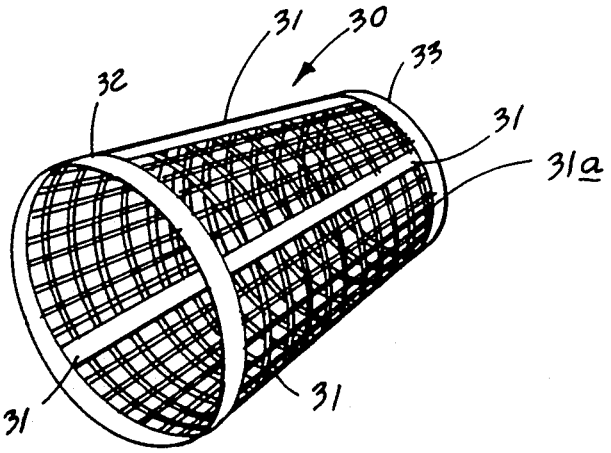

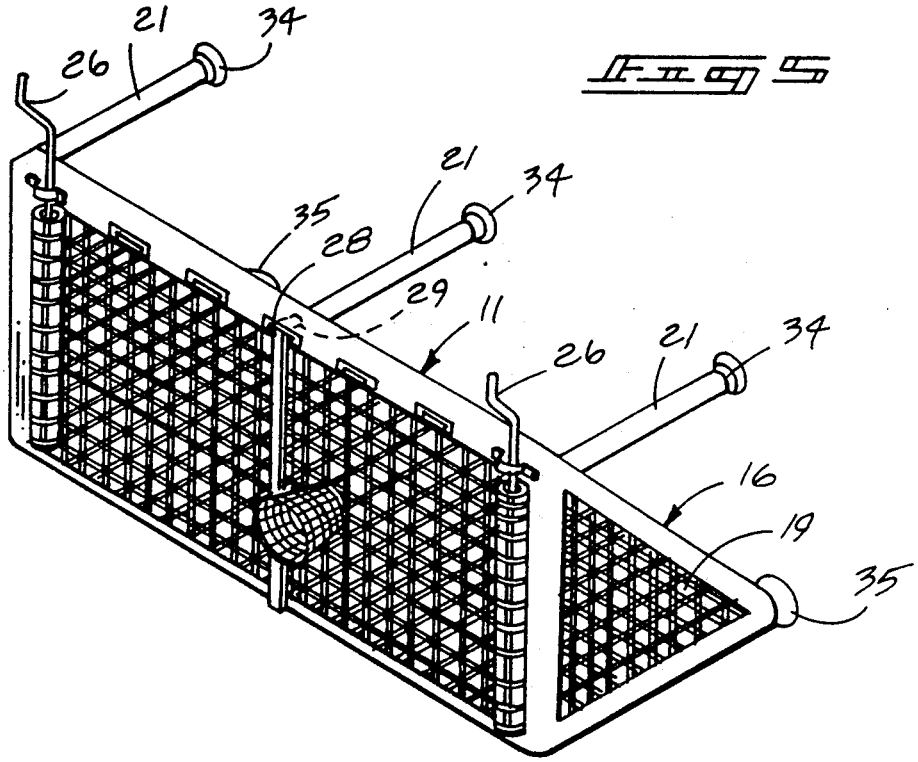
Fig 5
Fig 6
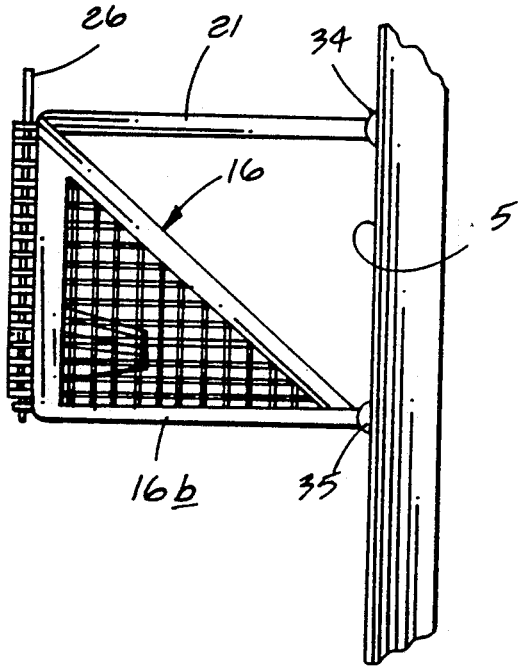

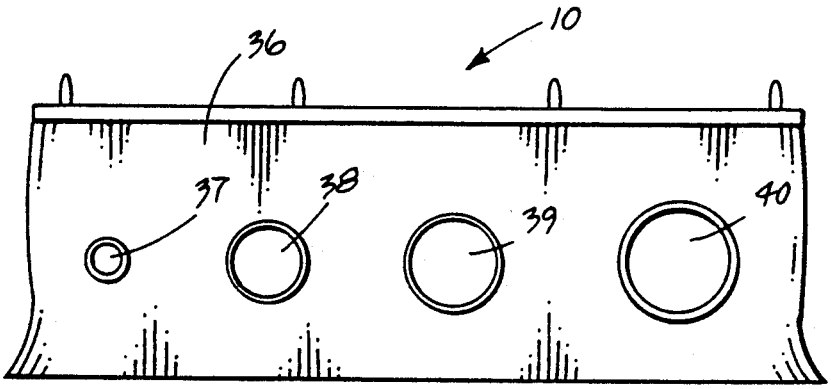
FIG 7
FIG 8
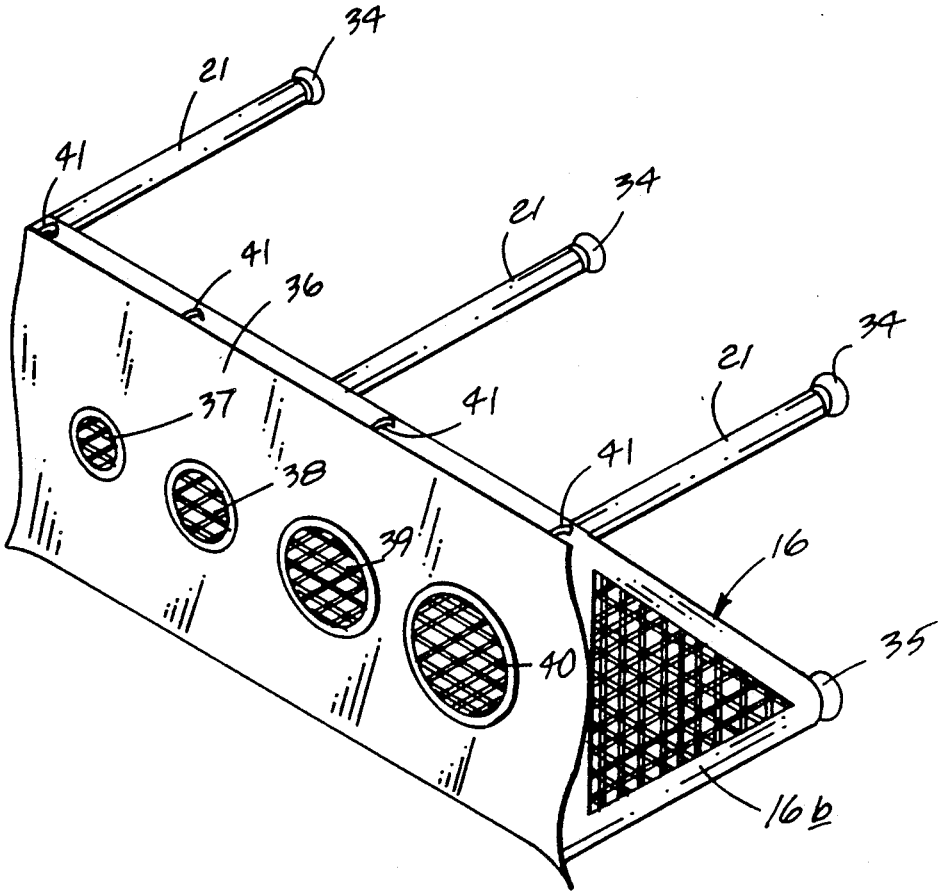

PORTABLE SOCCER GOAL APPARATUS

BACKGROUND OF THE INVENTION

1. Field of the Invention

The field of the invention relates to game apparatus, and more particularly pertains to a new and improved portable soccer goal apparatus wherein the same provides for a structure selectively positionable upon a horizontal or vertical support surface to provide targets of varying positions and sizes in use.

2. Description of the Prior Art

Target games of various types have been provided in the prior art. In the play of soccer, rigorous and repetitive practice is required for proficiency. The prior art target net games utilizing a ball usually employ a target for positioning relative to an individual. The instant invention attempts to overcome deficiencies of the prior art by providing a target utilizing a virtually unlimited positioning arrangement relative to a forward net surface to sharpen and enhance skills of an individual utilizing the organization. Examples of the prior art include French Patent 324,989 setting forth various compartmentalized members of a vertically arranged rack mounted on a table tennis type table providing various targets for the ball associated with the game.

U.S. Pat. No. 3,197,208 to MAKAR sets forth a vertically adjustable aiming target utilized in a golf game and wherein the target is positionable relative to adjustment of the golf swing in practice of the game.

U.S. Pat. No. 4,523,760 to BEDNARCZUK provides a golf driving net assembly wherein the net is formed of a frame with the net wrapped around the frame and secured therethrough by loops mounted about the frame member to provide a visible target for a practicing of golf.

U.S. Pat. No. 4,556,219 to TILLERY sets forth a golf practice cage wherein the cage provides an enclosure with a forward open end to receive golf balls directed therein during a practice session of golf.

U.S. Pat. No. 4,750,744 to MICHALEC wherein a golf practice device includes a frame and a series of fixed openings mounted to the frame directed into an underlying bucket to provide various targets in a golf swing practice session.

As such, it may be appreciated that there continues to be a need for a new and improved portable soccer goal apparatus which addresses both the problems of ease of use as well as effectiveness in presenting a myriad of targets in a practice environment of soccer and in this respect, the present invention substantially fulfills this need.

SUMMARY OF THE INVENTION

In view of the foregoing disadvantages inherent in the known types of portable goal apparatus present in the prior art, the present invention provides a new and improved portable soccer goal apparatus wherein the same provides a variety of targets as well as a multipositionable target in the directing of a soccer ball. As such, the general purpose of the present invention, which will be described subsequently in greater detail, is to provide a new and improved portable soccer goal apparatus which has all the advantages of the prior art goal apparatus and none of the disadvantages.

To attain this, the portable soccer goal apparatus of the invention includes apparatus including a rectangular forward framework with a triangular framework mounted rearwardly and orthogonally to each end of the rectangular framework with a net structure overlying the triangular framework rearwardly of the forward framework. The forward framework includes a horizontally repositionable forward net wherein the forward net includes a target cup of relatively rigid construction relative to the forward net and repositionable therewith to provide a rear end target position. The forward net may be removed with a flexible web overlying the forward framework mounting a series of diametrically aligned openings of increasing diameters to provide varying targets in use.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved portable soccer goal apparatus which has all the advantages of the prior art portable soccer goal apparatus and none of the disadvantages.

It is another object of the present invention to provide a new and improved portable soccer goal apparatus which may be easily and efficiently manufactured and marketed.

It is a further object of the present invention to provide a new and improved portable soccer goal apparatus which is of a durable and reliable construction.

An even further object of the present invention is to provide a new and improved portable soccer goal apparatus which is susceptible of a low cost of manufacture with regard to both materials and labor, and which accordingly is then susceptible of low prices of sale to the consuming public, thereby making such portable soccer goal apparatuses economically available to the buying public.

Still yet another object of the present invention is to provide a new and improved portable soccer goal apparatus which provides in the apparatuses and methods of the prior art some of the advantages thereof, while simultaneously overcoming some of the disadvantages normally associated therewith.

Still another object of the present invention is to provide a new and improved portable soccer goal apparatus which may be compactly stored when not being utilized.

Yet another object of the present invention is to provide a new and improved portable soccer goal apparatus wherein the same presents a multi-positionable framework for mounting on a horizontal or planar support surface and wherein the framework provides a vertically oriented net with a variety of targets directed therethrough as well as a multipositionable target for providing a target during a practice of directing soccer balls at a preselected goal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the instant invention.

FIG. 4 is an isometric illustration of the target basket of the instant invention.

FIG. 5 is an isometric illustration of the instant invention illustrating the use of a series of suction cups mounted to the framework.

FIG. 6 is an orthographic end view of the instant invention as illustrated in FIG. 5 as mounted to a support surface.

FIG. 7 is an orthographic view taken in elevation of the target web utilized in association with the framework of the instant invention.

FIG. 8 is an isometric illustration of the target web of the instant invention in use with the framework.

DESCRIPTION OF THE PREFERRED EMBODIMENT

Figure 1:
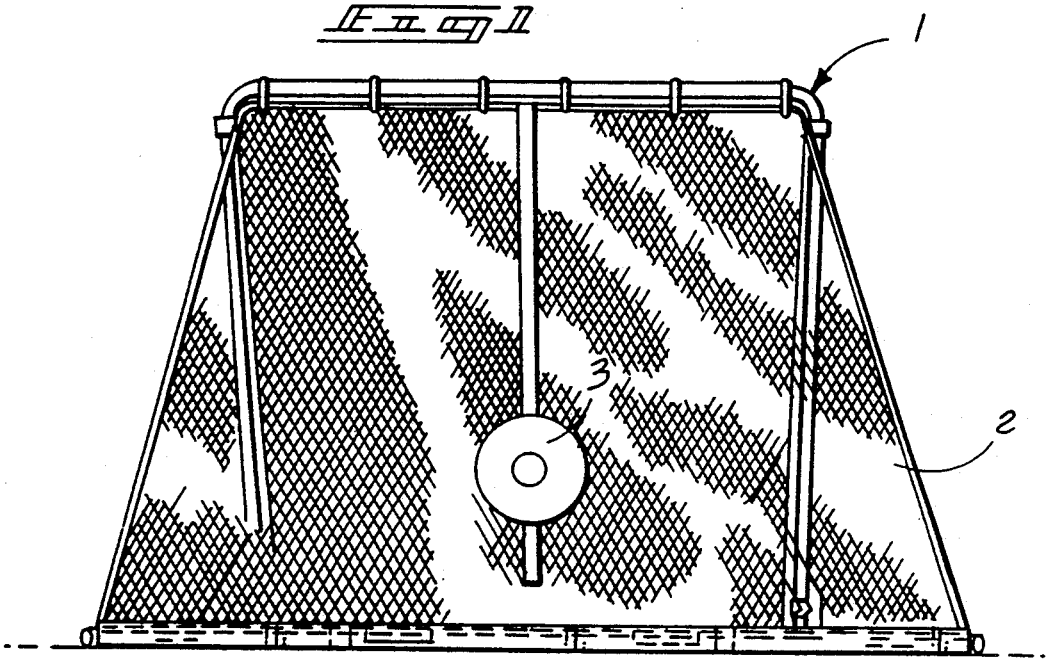
FIG. 1 is an orthographic view taken in elevation of a prior art target net.

With reference now to the drawings, and in particular to FIGS. 3 to 8 thereof, a new and improved portable soccer goal apparatus embodying the principles and concepts of the present invention and generally designated by the reference numeral 10 will be described.

Figure 2:
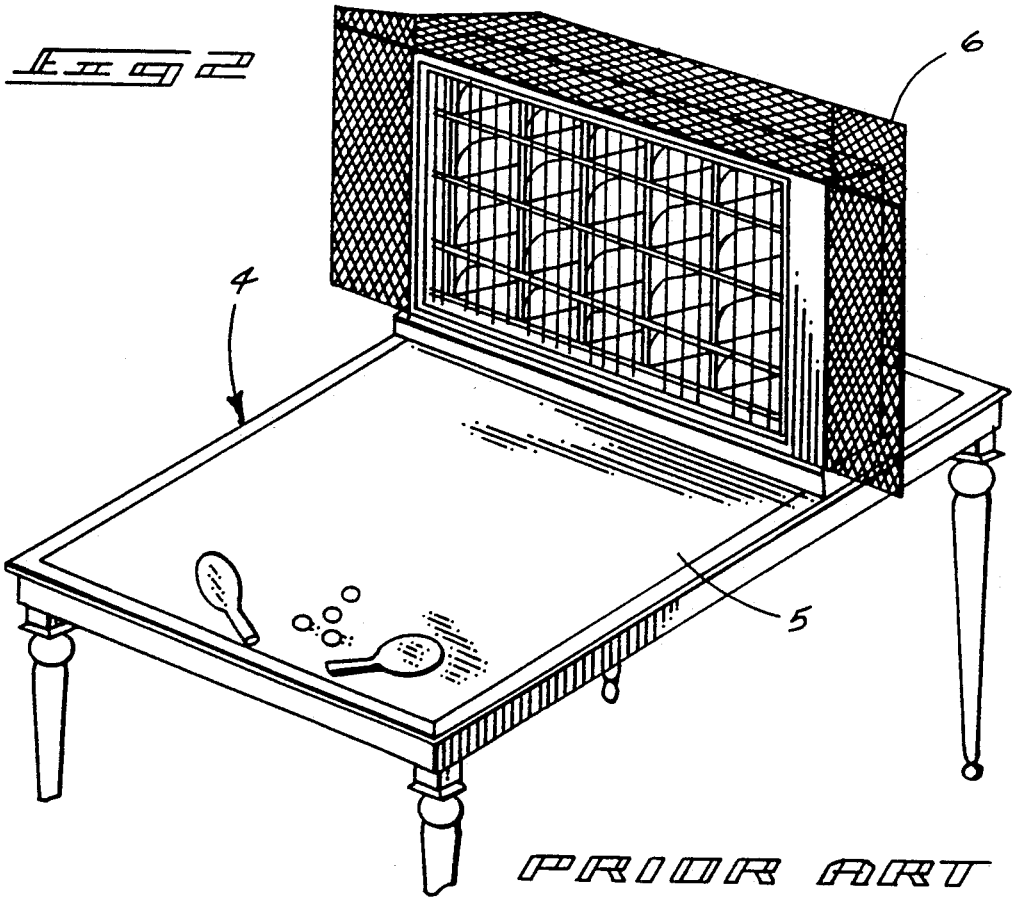
PRIOR ART Fig 2
FIG. 2 is a further prior art example of a target arrangement for use in the directing of a game ball.

FIG. 1 illustrates a prior art target net organization 1 wherein a framework 2 includes a clamshell type enclosure with a target 3 positioned medially of a rear surface of the enclosure and frequently positionable for adjusting a target relative to a projectile directed at a target. FIG. 2 illustrates a table tennis type table 4 including a top surface 5 with a housing structure 6 and rearwardly positioned net arrangement to permit directing the balls within one of the various enclosures of the housing structure 6.

More specifically, the portable soccer goal apparatus 10 of the instant invention essentially comprises a forward rectangular framework 11 including a right vertical plate 12 spaced from and parallel to a left vertical plate 13 of a coextensive predefined length and including a top horizontal plate 14 overlying and spaced from a bottom horizontal plate 15. A right triangular frame member 16 and a left triangular frame member 17 extend rearwardly and orthogonally relative to the rectangular framework 11. Each triangular frame member is defined as a right triangular member. For example the right triangular frame member 16 includes a vertical leg **16*a* coextensive with and fixedly mounted to a rear of the right vertical plate 12 with a horizontal leg 16*b* directed orthogonally and rearwardly of the right vertical plate 12. The left triangular frame member 17 includes a vertical and horizontal leg of equal positioning and arrangement. Triangular side nets 18 enclose the right and left triangular frame members 16 and 17 with a rear net 19 overlying a hypotenuse of each triangular frame member and stretched coextensive with the top horizontal plate 14**.

A bottom net 20 is secured between the horizontal legs of each of the triangular frame members 16 and 17 and coextensive with and affixed to the bottom horizontal plate 15. Support legs 21 are orthogonally and integrally affixed to the top horizontal plate 14 adjacent each terminal end of the top plate 14 with a central support leg mounted medially of the top plate 14. The legs 21 extend rearwardly a predetermined length substantially equal to a predetermined length defined by the horizontal leg of each triangular frame member 16 and 17 parallel to such horizontal legs. The top plate 14 includes a series of aligned and equally spaced slots 22. A frontal net member 23 is rotatably wound at each end of the frontal net member 23 to a respective right and left reel member 24 and 25. Each reel member includes a respective right and left handle crank 26 and 27 to permit manual horizontal displacement of the frontal net member 23 relative to the forward rectangular framework 11. A rigid positioning rib 28 extends parallel to each of the right and left reel members 24 and 25 which are also arranged parallel to one another and affixed to respective front surfaces of the right and left vertical plates 12 and 13.

The positioning rib 28 includes a lower end extending in an overlying relationship relative to the bottom plate 15 with a top terminal end of the rib 28 including a top leg 29 directed rearwardly and orthogonally relative to the rib 28 to be selectively received within one of the slots 22 to assist in affixing the frontal net member 23 in a predetermined relationship relative to the forward framework 11. A basket member 30 is mounted to the rib 28 and projects rearwardly of the frontal net member 23 in an orthogonal relationship. The basket member 30 is formed of a truncated conical configuration including an annular forward and rear opening that are coaxially aligned relative to one another with the forward opening of a greater diameter than that of the rear opening. Reinforcing ribs 31 extend between the forward and rear annular rings 32 and 33 at 90 degrees spacing relative to one another with a basket net **30*a* secured to each of the reinforcing ribs and the forward and rear rings to provide geometric integrity to the organization. In this manner, the basket member 30 is selectively positionable horizontally relative to the framework 11** in use.

To enhance securement of the apparatus 10 to either a horizontal support surface or a vertical support surface S as illustrated in FIG. 6 for example, the support leg suction cup members 34 are mounted to rear terminal ends of the support legs 21 with horizontal leg suction cup members 35 mounted to rear terminal ends of the horizontal legs of each of the triangular frame members.

FIGS. 7 and 8 illustrates the use of a flexible covering web 36 mounted overlying the horizontal framework 11 upon removal of the right and left reel members 24 and 25. The covering web 36 includes a series of diametrically aligned openings comprising a first opening 37, a second opening 38, a third opening 39, and a fourth opening 40. The respective openings are of an ever increasing diameter wherein the first opening is defined by a first diameter and the second opening is defined by a second diameter greater than the first diameter with a third diameter of the third opening greater than of the second opening with the fourth opening defining a fourth diameter greater than the third diameter.

Clip members 41 are mounted to a top longitudinal edge of the flexible covering web 36 for securement within the aforenoted slots 22. In use therefore it is understood that the flexible web covering 36 is mounted to the forward rectangular framework 11 upon removal of the right and left reel members 24 and 25 and the associated frontal net member 23 to provide a series of targets for use.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A portable soccer goal apparatus comprising, a forward rectangular framework, the forward rectangular framework includes a right vertical plate of a predetermined length spaced from and parallel to a left vertical plate defined by a predetermined length, and a top horizontal plate defined by a further predetermined length spaced from and parallel to and underlying bottom horizontal plate defining the rectangular framework, and a right triangular frame member extending rearwardly of the right vertical plate spaced from and parallel to a left triangular frame member directed rearwardly and orthogonally to a left vertical plate, and a frontal net member mounted overlying the forward rectangular framework, and positioning means mounted to the forward rectangular framework for positioning the frontal net member between the right and left vertical plate, and a basket member mounted through-extending the frontal net member fixedly thereto for horizontal displacement of the basket member with the frontal net member, and wherein the right triangular frame member includes a right vertical leg orthogonally mounted to a right horizontal leg, the right vertical leg coextensive with and integrally mounted to a rear surface of the right vertical plate, and the horizontal leg extending rearwardly and orthogonally relative to a lower terminal end of the right vertical plate, and a hypotenuse leg extending between an upper terminal end of the right vertical leg and a rear terminal end of the right horizontal leg spaced from the right vertical plate, and the left triangular frame member including a left vertical leg fixedly mounted to and coextensive with the left vertical plate, and left horizontal leg orthogonally mounted to a lower terminal end of the left vertical leg extending rearwardly and orthogonally relative to the left vertical plate, and a left hypotenuse leg extending between an upper terminal end of the left vertical leg and a rear terminal end of the left horizontal leg, and a rear net member mounted coextensively between the right and left hypotenuse leg and coextensive with and mounted to the top horizontal plate at a rear surface thereof, and wherein the positioning means includes a right reel member mounted to a forward surface of the right vertical plate, and a left reel member mounted to a forward surface of the left vertical plate, the right and left reel members rotatably mounting the frontal net member therebetween, and each right and left reel member respectively mounts a right and left handle crank to permit manual displacement of the frontal net member upon rotation of the respective right and left handle crank.

2. Apparatus as set forth in claim 1 further including a rigid positioning rib, the positioning rib mounted to the frontal net member, and the right and left reel members spaced parallel relative to one another, and the positioning rib positioned medially of the right and left reel members and parallel to the right and left reel members, and the basket member mounted to the positioning rib, the basket member including a forward annular ring and a rear annular ring wherein the forward and rear annular rings are coaxially aligned relative to one another and wherein the basket member further includes a series of reinforcing ribs integrally mounted between the forward and rear annular rings spaced apart at 90 degree angles relative to one another, the basket member extending orthogonally relative to the reinforcing rib directed rearwardly of the frontal net member.

3. Apparatus as set forth in claim 2 further including a first support leg mounted orthogonally and rearwardly of a top horizontal plate adjacent a left terminal end of the top horizontal plate, and a second support leg mounted rearwardly and orthogonally relative to a right terminal end of the top horizontal plate and extending rearwardly thereof, and a third positioning leg directed rearwardly and orthogonally relative to the top horizontal plate positioned medially of the first and second support legs wherein the first, second, and third support legs are arranged parallel to one another and the first, second, and third support legs are defined by a predetermined leg length, the right and left horizontal legs of the respective right and left triangular frame members defined by horizontal leg length equal to the predetermined leg length of the first, second, and third support legs.

4. Apparatus as set forth in claim 3 including a top suction cup member mounted to a rear terminal end of each of the support legs, and a bottom suction cup mounted to each rear terminal end of each horizontal leg of each triangular frame member.

5. Apparatus as set forth in claim 4 wherein the rigid positioning rib includes a top leg directed rearwardly and orthogonally relative to a top terminal end of the rigid positioning rib, wherein the top leg is selectively received within one of said slots.

6. Apparatus as set forth in claim 5 wherein the right and left reel members are respectively removable from the right and left vertical plates, and further including a flexible covering web mounted to and overlying the forward rectangular framework, the covering web including a series of clip members receivable within the slots to secure the covering web to the top horizontal plate, and the covering web including a series of diametrically aligned openings spaced apart at equal intervals through the covering web.

* * * * *